United States Patent [19]

Carlsson

[11] 4,006,311

[45] Feb. 1, 1977

[54] STEREOPHONIC SOUND REPRODUCING APPARATUS

[76] Inventor: Stig Carlsson, Torkel Knutssonsgatan 15, Stockholm, Sweden

[22] Filed: Feb. 11, 1976

[21] Appl. No.: 657,226

Related U.S. Application Data

[63] Continuation of Ser. No. 498,573, Aug. 19, 1974, abandoned.

[30] Foreign Application Priority Data

Aug. 24, 1973 Sweden ..... 7311562

[52] U.S. Cl. ..... 179/1 GA; 179/1 E; 181/147; 181/154

[51] Int. Cl.[2] ..... H04R 1/02; H04R 5/02

[58] Field of Search ..... 179/1 GA, 1 E; 181/144–156

[56] References Cited

UNITED STATES PATENTS

| | | | |
|---|---|---|---|
| 2,979,149 | 4/1961 | Carlsson | 181/147 |
| 3,104,729 | 9/1963 | Olson | 179/1 G |
| 3,360,072 | 12/1967 | Carlsson | 179/1 E |
| 3,627,948 | 12/1971 | Nichols | 179/1 GA |

FOREIGN PATENTS OR APPLICATIONS

| | | | |
|---|---|---|---|
| 325,519 | 12/1954 | Switzerland | 179/1 E |
| 1,012,505 | 12/1965 | United Kingdom | 179/1 E |
| 891,014 | 3/1962 | United Kingdom | 179/1 E |

*Primary Examiner*—George G. Stellar
*Attorney, Agent, or Firm*—Burmeister, York, Palmatier, Hamby & Jones

[57] ABSTRACT

A loudspeaker combination comprises a rectangular casing having mounted on its top wall a midfrequency speaker and two or more high frequency speaker devices. The midfrequency speaker is oriented generally upwardly with an angle of declination of less than 45° from the vertical. The high frequency speakers are oriented generally horizontally, with a slightly upward inclination. The axis of the midfrequency speaker and of at least one of the high frequency speakers are slanted sideways in the same general direction. This latter speaker or speakers radiates at least substantially one-half of the total high frequency sound energy of the loudspeaker combination. The remaining high frequency speaker or speakers radiate in different directions, preferably toward an adjacent wall or walls. In one embodiment the midfrequency speaker device also radiates low frequency sound; in another, a separate low frequency speaker device is provided. Two of such speaker combinations, mirror images of each other and widely spaced laterally from each other, provide a stereophonic system.

7 Claims, 10 Drawing Figures

STEREOPHONIC SOUND REPRODUCING APPARATUS

This is a continuation of application Ser. No. 498,573, filed Aug. 19, 1974 now abandoned.

This invention relates to stereo loudspeaker systems having two loudspeakers for stereophonic reproduction or four loudspeakers for quadraphonic reproduction. The invention is concerned with the orientation and location of the sound radiating means of said loudspeakers with respect to an adjacent wall of the listening-room and with respect to a diagonal direction towards the listening area from each loudspeaker in the room.

An object of my invention is to provide a stereo loudspeaker system which can provide the most natural and life-like reproduction of stereophonic or quadraphonic recordings in normal domestic environments, such as the average moderately damped living-room.

Another object of my invention is to provide a stereo loudspeaker system which can provide a natural and life-like stereophonic reproduction within a fairly large part of the listening-room when the loudspeakers are placed in normal positions with their horizontal outlines parallel to the walls of the room.

From a sound source or a group of sound sources, such as a stereo loudspeaker system in a room, a listener first receives direct sound and after that a succession of reflected sound from various directions. The relative strength and directions of the early reflected sound depend on the directional pattern of the sound source and on the distribution of sound reflecting and sound absorbing material in the room, while the rate of decay of the reflected sound — expressed by the reverberation time — only depends on the room and the amount of sound absorbtion in the room. The directional patterns of loudspeakers vary with frequency, because a sound radiating surface, such as a vibrating diaphragm or the mouth of a horn or a port, is nondirectional at low frequencies when its dimensions are smaller than the wave-length of the sound, and directional at high frequencies — more the higher the frequency — when its dimensions are of the same order or larger than the wavelength of the sound.

If the physical description of the sound stimuli produced by a sound source, such as a pair of loudspeakers in a room appears to be rather complex, the problem of finding which directional pattern is likely to provide the most natural and life-like stereophonic reproduction, is complicated still more by the fact that little is known about the mechanisms of human hearing, and how the listener's sensations and perceptions are influenced by exposure to early reflected sound — from various directions — accompanying the initially received direct sound.

The idea that reflected sound is disadvantageous, and that directional loudspeakers radiating within an horizontal angle of about $\pm\pi/4$ radians are optimum for stereophonic reproduction, is widely spread, and loudspeakers having all their sound radiating means facing forwards are most common. But loudspeakers of the ominidirectional type, more or less imitating a nondirectional source, have also found supporters. Incidentally, the observation that in a concert hall the direct sound averages only about one-ninth of the total sound energy received, inspired one inventor to use one loudspeaker means facing forwards for providing direct sound and eight loudspeaker means facing rearwardly for providing reflected sound (U.S. Pat. No. 3,727,004 when referring to loudspeaker system of U.S. Pat. No. 3,582,553).

The present invention is based on my observation that a modified type of omnidirectional loudspeaker which has from two to four times higher ratio of direct to reflected sound than a perfectly nondirectional source, is required to provide a truly natural and life-like stereophonic or quadraphonic reproduction in rooms which discriminating music-listeners find acoustically satisfying.

In my invention, the desired ratio of direct to reflected sound — within an omnidirectional type of radiation — is obtained by combining two fundamentally different means to control the ratio of direct to reflected sound: the choice of the orientation and the choice of the location of the sound radiating means of the loudspeakers.

The location of the sound radiating means provides a means to halve — once, twice, or three times — the solid angle into which the loudspeakers radiate the low frequency components of the sound. Such a halving will occur when the low frequency sound radiating means is located in that part of the loudspeaker which will be placed close to reflecting planes such as a wall or floor of the listening-room, if the spacing between said reflecting plane and the center of the sound source provided by said low frequency sound radiating means is less than one-tenth of the wavelength of the sound. Each halving of the solid angle of radiation of the low frequency component increases the ratio of direct to reflected sound by a factor of two.

Even above the low frequency range, the location of the sound radiating means provides a means to increase the ratio of direct to reflected sound, because of an aural effect called masking. My previous British Pat. No. 1,012,505/ Danish Pat. No. 106,677/ Dutch Pat. application No. 298,920/ French Pat. No, 1,422,831/ German Pat. No. 1,303,535.3-9/ U.S. Pat. No. 3,360,072 describes a loudspeaker whose mid frequency sound radiating means is located near the rear wall of the loudspeaker. When said loudspeaker is placed with its rear wall close to a wall of the listening-room, the spacing between said wall of the room and the sound radiation source provided by said mid frequency sound radiating means will be small. The sound from the image of the source will then arrive at the listener's head with a time lag (relative to the direct sound from the source) that is sufficiently short as to be within the reaction time of human hearing. This location of the mid frequency sound radiating means provides a masking of reflected sound which — for a nondirectional source — corresponds to an increase of the ratio of direct to reflected sound by a factor of substantialy two, when the center of the source is spaced less than substantially 20 cm from the adjacent wall of the listening-room.

In substantial parts of the mid and high frequency ranges, the orientation of the sound radiating means provides a means to control the directional patterns of the loudspeakers in order to achieve the desired increased ratio of direct to reflected sound. In the present invention the orientation of the high and mid frequency sound radiating means is chosen in such a way as to provide increased radiation towards a listening area near the center or back center of the listening-room, i.e., in a diagonal horizontal direction of the room. The orientation of the sound radiating means, and the resulting directional patterns, are for this reason arranged to be unsymmetrical with respect to vertical planes that are perpendicular to the rear wall of the loudspeaker as well as with respect to vertical planes that are parallel to the rear wall of the loudspeaker, and in order to keep the stereo symmetrical, the two loudspeakers forming a stereo loudspeaker system according to the invention are made mirror images of each other with respect to a vertical plane that is perpendicular to the rear walls of the two loudspeakers.

For the mid frequency components of the sound, the wavelengths cover a range of dimensions that includes the external dimensions of high fidelity loudspeakers. Loudspeaker means suitable for high fidelity reproduction of this frequency range usually have broad directional patterns — being almost nondirectional — at the lower end of the frequency range, and turn gradually into a narrower directional pattern towards the upper end of the frequency range. The orientation of the loudspeaker means relative to the listener's head will determine how the ratio of direct to reflected sound will vary according to the frequency. When the loudspeaker means faces the listener's head, a maximum of increase of the ratio of direct to reflected sound at the upper end of the frequency range is obtained, and when it faces away from the listener, the ratio of direct to reflected sound will decline heavily towards the upper end of the frequency range.

In the present invention, the mid frequency sound radiating means is arranged to face in a diagonal direction outwardly into the listening-room, towards the above-mentioned listening-area, and inclined upward. By combining this orientation with the abovementioned location of the mid frequency sound radiating means near the rear wall of the loudspeaker — which employs the above-mentioned masking effect to increase the ratio of direct to reflected sound — I have provided a mid frequency sound radiation source which has the desired ratio of direct to reflected sound practically independent of the frequency. Furthermore, when required, a slight increase or decrease of the ratio of direct to reflected sound towards the high end of the frequency range can easily be built into the loudspeaker by choosing a different degree of inclination of the sound radiating means.

For the high frequency components of the sound, the wavelengths are shorter than the external dimensions of high fidelity loudspeakers, and cover a range of dimensions which includes the external dimensions of loudspeaker means suitable for high fidelity reproduction of this frequency range as well as the diameters of their sound radiating surfaces. The directional patterns of suitable loudspeaker means of small size are relatively broad at the lower end of the frequency range, and relatively narrow at the upper end. From a typical example of such a loudspeaker means radiating into a solid angle of $\pi$ radians, the response in directions 45° off axis is O dB down at 2kHz, 3 dB down at 7 kHz, and 6 dB down at 13 kHz as compared to the on-axis response. The high frequency sound radiating means of loudspeakers of the omnidirectional type comprises a plurality of such loudspeaker means facing in horizontally different directions.

To provide the desired increased ratio of direct to reflected sound, the high frequency sound radiating means of the loudspeaker of the present invention is arranged to provide a direct-sound radiation source and at least one reflected-sound radiation source, the direct-sound radiation source being arranged to radiate substantially from one-half to four-fifths of the total frequency sound radiation of the loudspeaker. Said direct-sound radiation source is arranged to radiate outwardly into the listening-room, within a horizontal angle of $\pi/2$ radians which contains the stereophonic or quadraphonic listening-area of the room. Said at least one reflected-sound radiation source is arranged to radiate into the remaining horizontal angle of $3\pi/2$ radians towards at least the adjacent wall of the room in front of which the loudspeaker is placed and in such a way as to provide the listener with early reflected sound from said adjacent wall of the room as well as from an adjacent sidewall of the room.

There are different ways to achieve this distribution of the high frequency sound radiation. One way has a plurality of loudspeaker means for the high frequency range arranged to face in different directions which are substantially evenly distributed throughout the horizontal angle of $2\pi$ radians, including at least one loudspeaker means which is arranged to face into said horizontal angle of $\pi/2$ radians so as to provide a direct-sound radiation source. By electrical means substantially from two to four times more power is arranged to be fed into each of said at least one loudspeaker means that is arranged to face into said horizontal angle of $\pi/2$ radians, than into each of the remaining loudspeaker means. Another way has all the loudspeaker means for the high frequency range arranged to be fed by the same amount of power. Substantially from one-half to four-fifths of the total number of said loudspeaker means is arranged to face into said horizontal angle of $\pi/2$ radians so as to form said direct-sound radiation source, while the remaining number of said loudspeaker means is arranged to face into said remaining horizontal angle of $3\pi/2$ radians in such a way as to form said reflected-sound radiation source. This other way in its pure form, or a combination of parts of both ways, are chosen in preferred embodiments of the invention.

It is a characteristic quality of a good omnidirectional loudspeaker that it provides an impression of plasticity, resembling that of a natural sound source standing free in a room or hall. This important characteristic is retained in the present invention by locating a reflected-sound radiation source of said high frequency sound radiating means near the front end of the loudspeaker and facing in a rearwardly direction. Referring to my above-mentioned previous patent, this reflected-sound radiation source should be spaced at least substantially 30 cm and preferably 40 or 50 cm from the adjacent wall of the listening-room.

According to the present invention, the loudspeaker for a stereophonic or quadraphonic sound reproducing system in rooms having at least one substantially vertical wall comprises a casing having a front end and a rear end intended to face said vertical wall, at least one loudspeaker means arranged in said casing so as to provide, near said rear end of the casing, a mid frequency sound radiation source as well as a low frequency sound radiation source, as a common source or as two separate sources, and a plurality of loudspeaker means facing in horizontally different directions, of which at least one is located near said front end of the casing and faces in a rearwardly direction, arranged to radiate the high frequency components of the sound. Said at least one loudspeaker means for the mid frequency range and at least one of said plurality of loudspeaker means for the high frequency range are arranged to face asymmetrically slantwise forwards to one side of an imaginary vertical plane perpendicular to said rear wall of the casing, the former facing in an upwardly direction, the latter being arranged to radiate at least substantially one-half of the total high frequency sound-energy flux of the loudspeaker.

The stereophonic loudspeaker system according to the invention comprises two loudspeakers as described which are made mirror images of each other with respect to an imaginary vertical plane that is perpendicular to the rear walls of the loudspeaker.

According to the teachings of the present invention, loudspeakers providing early reflected sound from all available reflecting surfaces, as omnidirectional loudspeakers do, are not predestined to provide a rather vague stereophonic effect with inadequate directional information. While an omnidirectional loudspeaker designed, to have the same intensity in all directions can provide satisfactory monophonic reproduction when positioned centrally in the listening-room, e.g. near the center of the longest wall, stereo loudspeakers are likely to be placed nearer to the corners of the room, and this appears to provide a lower ratio of direct to early reflected sound coming from roughly the same direction. If this lower ratio of direct to early reflected sound is compensated by a corresponding increase of the radiation in directions providing direct sound, and if, preferably, a further increase of the direct-sound radiation is added in order to pay due regard to the greater importance of the directional information in stereophonic as compared to monophonic reproduction, it is found that the advantages of having the direct sound supplemented by early reflected sound from reflecting walls adjacent to the loudspeaker are again apparent to the sensuous music listener.

With an object to clarify, but not to limit, the invention, a number of embodiments will be described with reference to the enclosed drawings.

Figure 1:
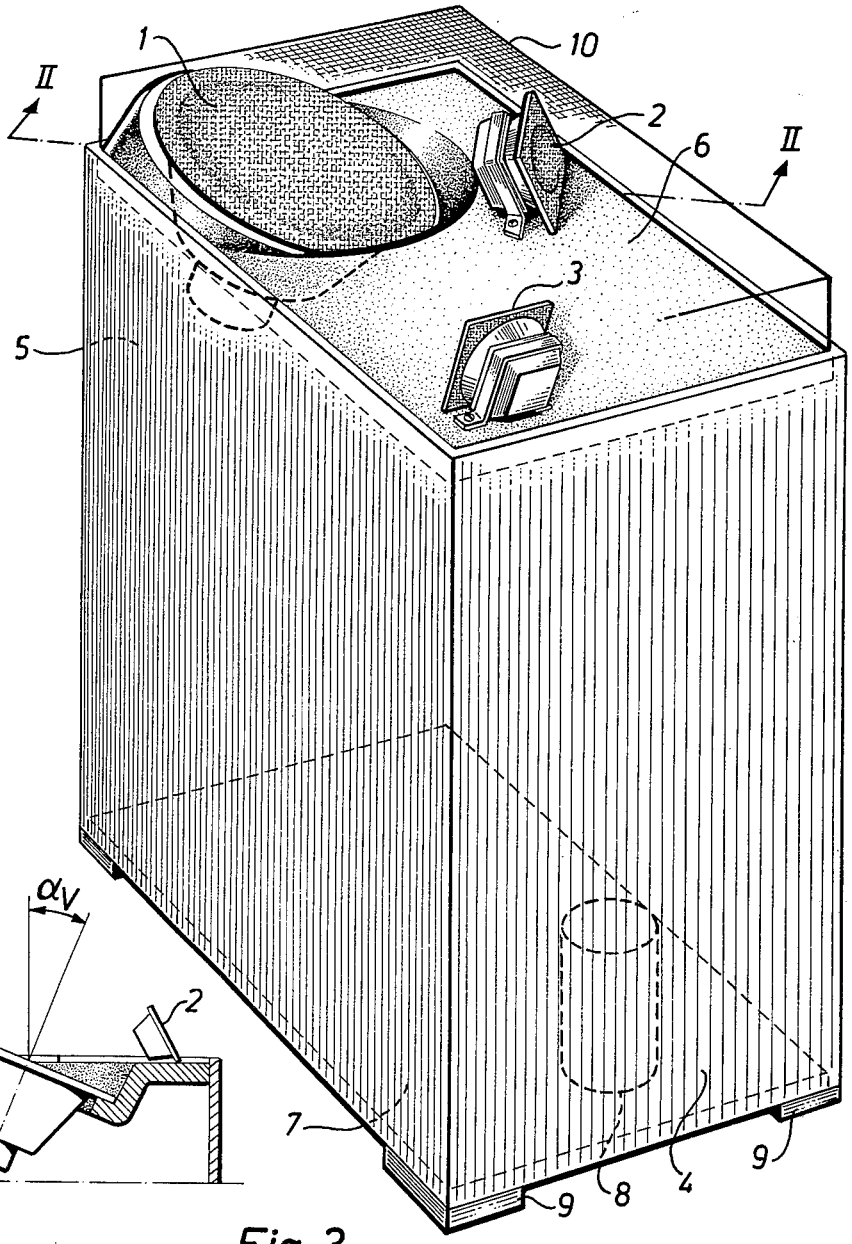
FIG. 1 is a perspective view of a loudspeaker according to the invention, having a single loudspeaker means arranged to provide a low and mid frequency sound radiation source, and two loudspeaker means arranged to radiate the high frequency range.
Figure 2:
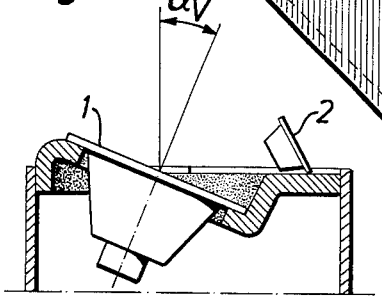
FIG. 2 is a section along line II—II of FIG. 1.
Figure 3:
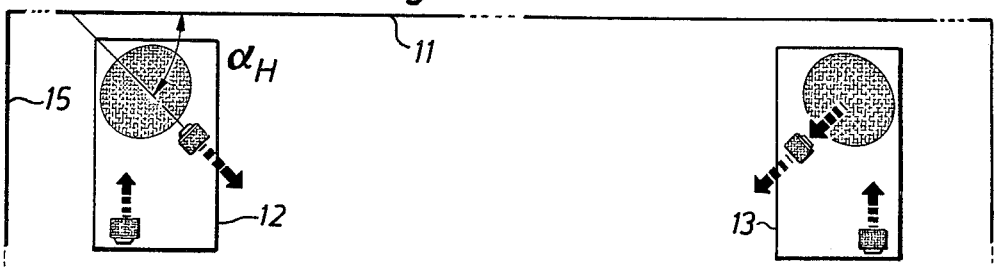
FIG. 3 is a plan view of a stereophonic loudspeaker system comprising two loudspeakers of the embodiment shown in FIGS. 1 and 2, placed along a vertical wall of a room.

The embodiment shown in FIGS. 1–3 reproduces the frequency range 40–20.000 Hz. The loudspeaker has a casing, or enclosure, in the shape of a right-angled parallelepiped having width 20 cm, depth 34 cm, and height 39 cm. The loud-speaker means arranged to provide a low and mid frequency sound radiation source is a loudspeaker mechanism 1 having an outer diameter of 16.5 cm, its sound radiating membrane or diaphragm having a diameter of 12.5 cm. This is mounted on the top wall 6 of the casing, near the rear wall 5, and the top wall 6 is adapted to hold it in an inclined position so that it faces slantwise upwards and forwards to the side where the listening-area is to be found in the room. Its symmetry axis makes an angle $\alpha_V = \pi/9$ radians with the vertical line, and an angle $\alpha_H = \pi/4$ radians with the rear wall 5 of the casing and thereby with the adjacent wall 11 of the room. The center of the low and mid frequency sound radiation source is only 10 cm from the rear wall 5 of the casing.

The loudspeaker means adapted to radiate the high frequency range are the two loudspeaker mechanisms 2 and 3 which have an outer diameter of 5 cm and a membrane with a diameter of 3.5 cm. They are mounted on the top wall 6 of the casing and oriented in such a way that the loudspeaker mechanism 2 faces slantwise forwards to the side where the listening-area is to be found in the room, so as to provide a direct-sound radiation source, while the loudspeaker mechanism 3 faces rearwards so as to provide a reflected-sound radiation source. The loudspeaker mechanism 3 is positioned near the front wall 4 of the casing in order to place the center of the reflected-sound radiation source at a horizontal distance of 30 cm from the rear wall 5 of the casing. With reference to loudspeaker 12 in FIG. 3, this loudspeaker mechanism provides reflected sound from the adjacent wall 11 as well as from the side wall 15, in the latter case by means of sound which is first reflected from the adjacent wall 11.

The loudspeaker mechanism 1 is adapted to radiate frequencies lower than approximately 2 kHz, while the loud-speaker mechanisms 2 and 3 are adapted to radiate the frequencies above that range. The bottom wall 7 of the casing has a tubular opening 8 which is adapted to assist in the reproduction of the very lowest frequencies, mainly below 80 Hz. At these low frequencies the opening 8 need not be near the rear wall 5 of the casing, because it will still be spaced less than one-tenth of a wavelength from the adjacent wall 11.

The casing is provided with feet 9 which keep the bottom wall 7 spaced from the floor. The top part of the loudspeaker is covered by a wire netting 10 in order to protect the loudspeaker mechanisms against mechanical damage.

The stereophonic loudspeaker system shown in FIG. 3 comprises two loudspeakers 12 and 13 which are mirror images of each other with respect to a vertical plane at right angles to the rear walls of the loudspeakers.

Figure 4:
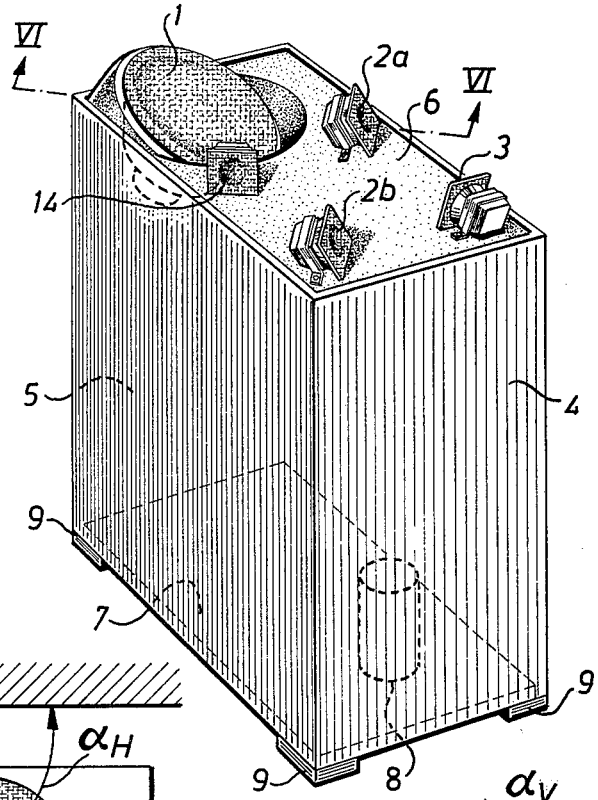
FIG. 4 is a perspective view of a modification of the loudspeaker shown in FIGS. 1–3, having four loudspeaker means arranged to radiate the high frequency range.
Figure 5:
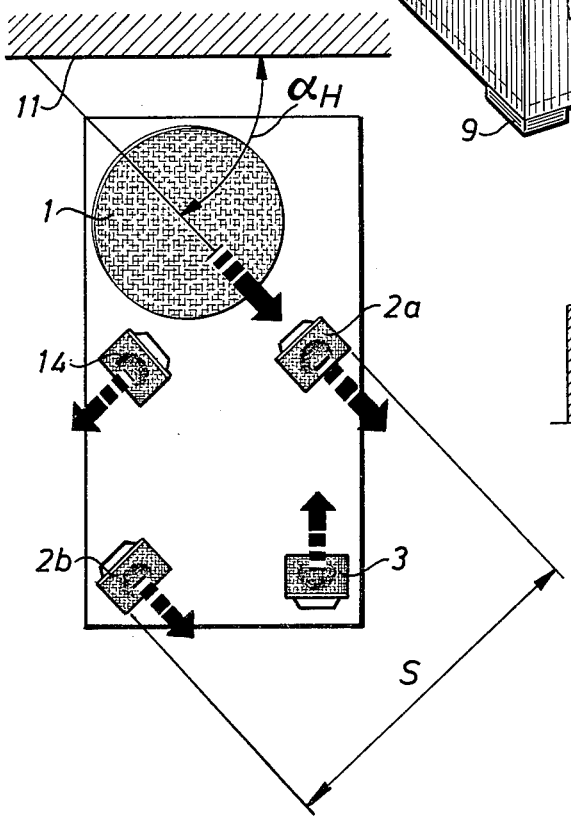
FIG. 5 is a plan view of the loudspeaker shown in FIG. 4, placed near a vertical wall of a room.
Figure 6:
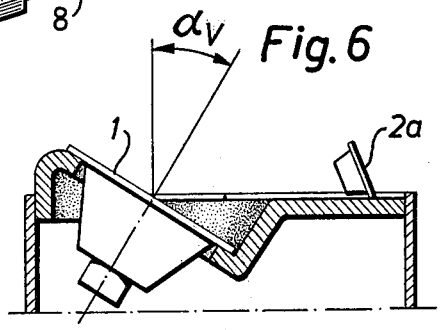
FIG. 6 is a section along line IV—IV of FIG. 4.

FIGS. 4–6 show a modification in which a larger casing is employed in order to widen the frequency response down to 25 Hz. The casing is 23 cm wide, 42 cm deep, and 49 cm high. The reference numerals 1, 3,

4, 5, 6, 7, 8 and 9 designate parts that have full correspondence in those parts having the same numerals in the loudspeaker described above. The larger casing has permitted the angle $\alpha_V$ to be increased to $\pi/6$ which is preferable, because this value makes the ratio of direct to reflected sound practically independent of the frequency throughout the mid frequency range. By doubling the number of loudspeaker means for the high frequency range, a more airy sound is obtained. The two loudspeaker mechanisms 2*a* and 2*b* provide the direct-sound radiation source, while another reflected-sound radiation source, the loudspeaker mechanism 14, provides reflected sound from the side wall (15 in FIG. 3) without requiring previous reflections from the adjacent wall 11. The distance S amounts to 25 cm.

Figure 8:
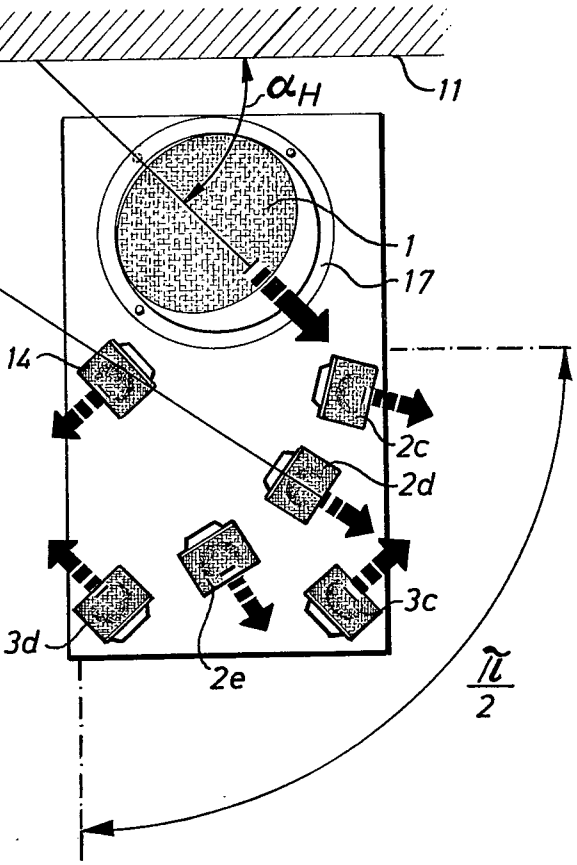
FIG. 8 is a plan view of the loudspeaker shown in FIG. 7, placed near a vertical wall of a room.
Figure 7:
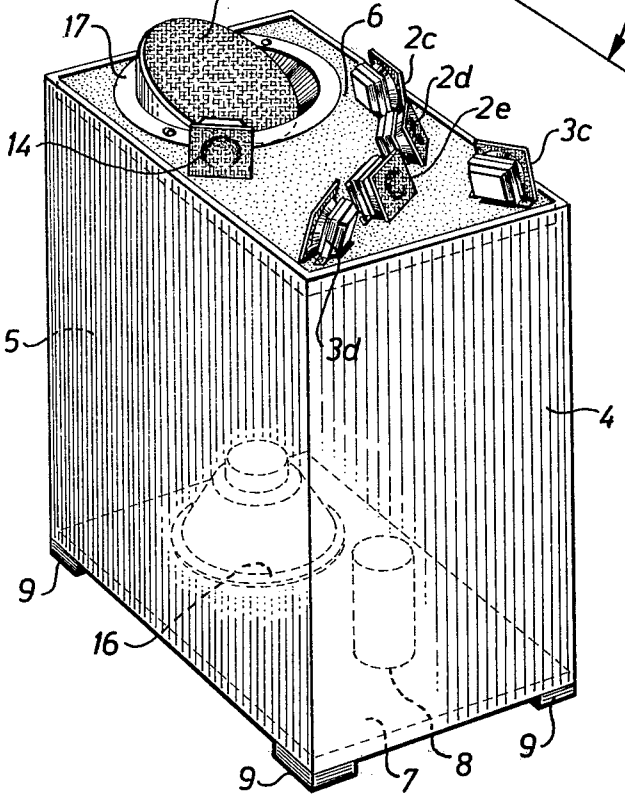
FIG. 7 is a perspective view of another loudspeaker according to the invention, having separate loudspeaker means for the low frequency sound radiation source and the mid frequency sound radiation source, and having six loudspeaker means arranged to radiate the high frequency range.

The loudspeaker shown in FIGS. 7 and 8 represent a further refinement. Two more loudspeaker mechanisms for the high frequency range and a separate loudspeaker mechanism 16 for the low frequency range are added to those of the preceding loudspeaker. Loudspeaker mechanism 16 is arranged in the bottom wall 7 of the casing, near the rear wall 5, and adapted to radiate the low frequency range from 25 Hz to approximately 400 Hz, at which frequency the loudspeaker mechanism 1 takes over. The loudspeaker mechanism 16 will be positioned close enough to both the adjacent wall and the floor of the listening-room to provide a notably increased ratio of direct to reflected sound in the low frequency range. In most rooms this is a requisite for a clear and distinct bass reproduction.

The loudspeaker mechanisms 2*c*, 2*d*, and 2*e* are arranged to provide a direct-sound radiation source for the high frequency range, making the angles $\pi/16$, $3\pi/16$, and $5\pi/16$ radians with the rear wall 5 of the casing, and thus with the room wall 11. They have a vertical symmetry plane that makes the angle $\beta_H = 3\pi/16$ with the rear wall 5 and the room wall 11. The loudspeaker mechanisms 3*c*, 3*d*, and 14 provide reflected-sound radiation sources oriented so as to face in widely different directions covering all useful reflecting surfaces in the listening-room.

Figure 10:
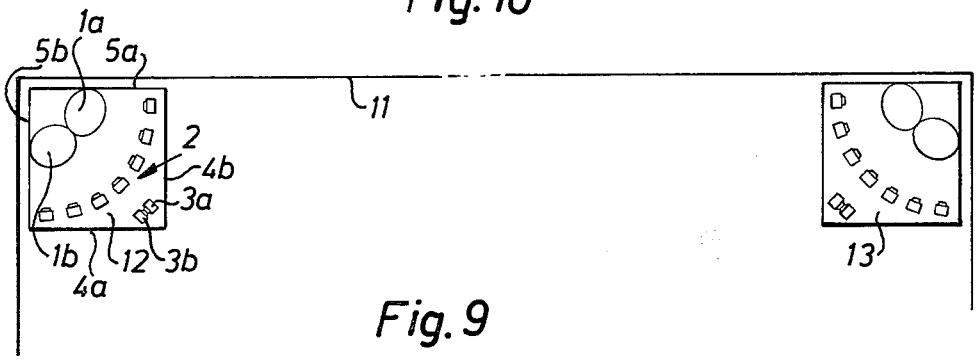
FIG. 10 is a plan view of a stereophonic loudspeaker system comprising two loudspeakers of the embodiment shown in FIG. 9, placed in the two corners along a vertical wall of a room.
Figure 9:
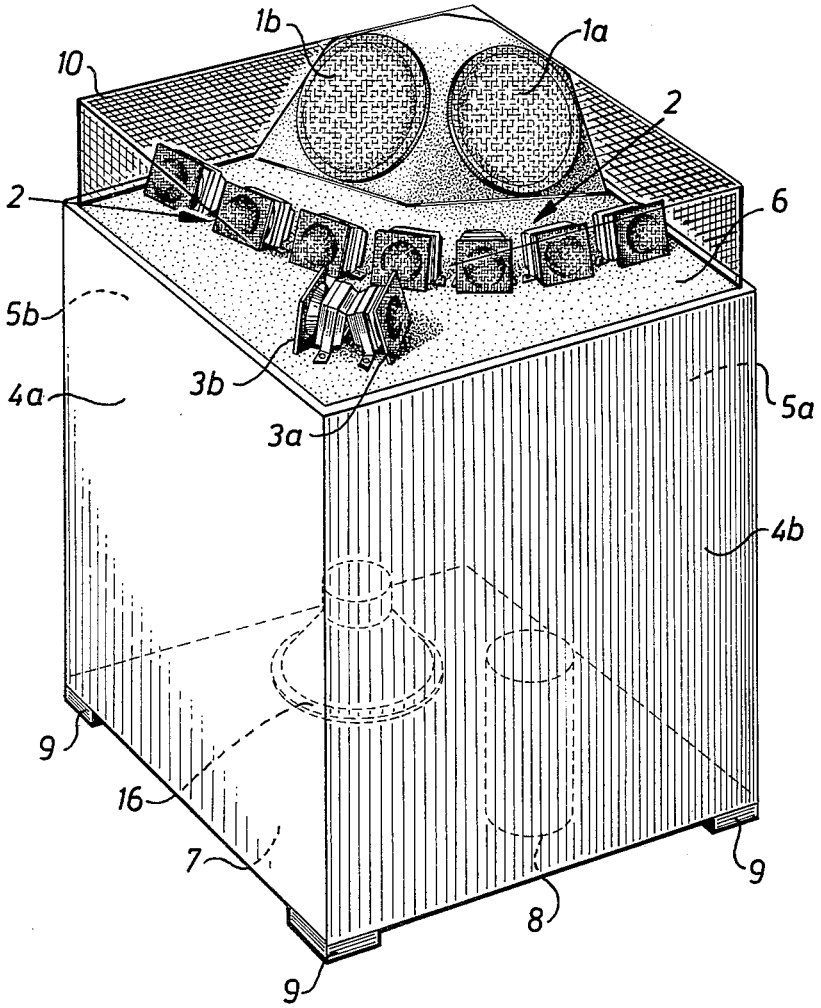
FIG. 9 is a perspective view of a modification of the loudspeaker shown in FIGS. 7 and 8, having two loudspeaker means for the mid frequency sound radiation source and nine loudspeaker means arranged to radiate the high frequency range.

A modification of the above loudspeaker, intended for larger rooms and for corner positioning, is shown in FIGS. 9–10. In this case the mid frequency source has two loudspeaker mechanisms 1*a* and 1*b* and its center is located 17 cm from each of the walls 5*a* and 5*b* of the casing. The direct-sound radiation source for the high frequency range consists of seven loudspeaker mechanisms 2, and as is the case with the other loudspeakers of the present invention, they are all oriented so as to face within an angle of $\pi/2$ radians which contains the listening-area of the room. The loudspeaker mechanisms 3*a* and 3*b* are oriented so as to provide reflected sound from both walls of the corner.

In a further modification the loudspeaker mechanisms designated by the reference numeral 2 is composed of electrostatic loudspeaker means having a curved shape. Further embodiments include loudspeakers having three and five loudspeaker mechanisms for the high frequency range, in which case loudspeaker mechanisms with unequal electrical impedance values are combined to feed unequal amounts of power into the loudspeaker mechanisms.

Although only preferred embodiments of the present invention has been described, it will be understood that various modifications and changes may be made in the constructions shown without departing from the scope of the invention as pointed out in the appended claims.

I claim:

1. A loudspeaker for use in a stereophonic or quadraphonic sound reproducing system in a room having at least one substantially vertical wall, comprising a casing having a front end and a rear end and intended to be placed with said rear end nearest to said vertical wall, at least one loudspeaker means arranged in said casing so as to provide, near said rear end of the casing, a midfrequency sound radiation source as well as a low frequency sound radiation source, and a plurality of loudspeaker means facing in widely diverging directions, of which loudspeaker means at least one is located near said front end of the casing and faces in a rearwardly direction, arranged to radiate the high frequency components of the sound, said at least one loudspeaker means for the midfrequency range and at least one of said plurality of loudspeaker means for the high frequency range being oriented to face asymetrically slantwise forwards and sidewards towards a space located on one side of a vertical medial plane extending from the front end to the rear end of said casing at right angles to the rear wall of said casing, said at least one loudspeaker means for the midfrequency range facing in an upwardly direction, and said at least one of said plurality of loudspeaker means for the high frequency range being arranged to radiate at least substantially one-half of the total high frequency sound-energy flux of said plurality of loudspeaker means for the high frequency range.

2. A loudspeaker for stereophonic and quadraphonic sound reproducing systems and intended to be placed near a vertical sound reflecting wall in a room, said loudspeaker comprising a casing having a front end and a rear end and intended to be placed with said rear end nearest to said sound reflecting wall, high frequency radiating means comprising a plurality of loudspeaker means mounted on said casing and oriented to face in widely diverging directions, said plurality of loudspeaker means including at least one loudspeaker means for providing direct sound and facing in a forwardly and sidewardly direction towards a space located asymetrically on one side of said casing, said plurality of loudspeaker means including at least another loudspeaker means for providing reflected sound and facing in at least a rearwardly direction, said at least one loudspeaker means which provides direct sound radiating at least substantially one-half of the total sound-energy flux of said high frequency radiating means, and mid and low frequency radiating means comprising at least one loudspeaker means mounted to said casing, near said rear end of the casing, said at least one loudspeaker means for the midfrequency range being oriented to face in an upwardly and forwardly and sidewardly direction pointing asymetrically to the same side of said casing as said at least one loudspeaker means which provides direct sound in the high frequency range.

3. A loudspeaker as claimed in claim 2 in which said at least one loudspeaker means for the midfrequency range faces in an upwardly and forwardly and sidewardly direction which forms an angle of substantially from $\pi/10$ to $\pi/4$ radians with the vertical.

4. A loudspeaker for use in a stereophonic or quadraphonic sound reproducing system, comprising a casing having a front end and a rear end, midfrequency radiating means comprising at least one loudspeaker means mounted on the top of said casing and oriented to face in an upwardly and forwardly and sidewardly direction pointing asymetrically to one side of said casing, and high frequency radiating means comprising a plurality of loudspeaker means mounted on said casing and oriented to face in widely diverging directions, said plurality of loudspeaker means including at least one loudspeaker means facing in a rearwardly direction and at least another loudspeaker means radiating at least substantially one-half of the total sound-energy flux of said high frequency radiating means and facing in a forwardly and sidewardly direction pointing asymetrically to the same side of said casing as said direction of said at least one loudspeaker means for the midfrequency range.

5. A loudspeaker as claimed in claim 4 in which said midfrequency radiating means also radiates the low frequency range.

6. A loudspeaker as claimed in claim 4 which includes a loudspeaker means located in the lower portion of said casing and near said rear end of the casing and radiating the low frequency range.

7. A stereo loudspeaker system to be placed near a vertical sound reflecting wall in a room, said stereo loudspeaker system comprising a left-hand and a right-hand loudspeaker which are mirror images of one another with respect to a centered vertical plane extending transverse to said sound reflecting wall midway between the loudspeakers; each loudspeaker comprising a casing having a front end and a rear end and intended to be placed with said rear end nearest to said sound reflecting wall, high frequency radiating means comprising a plurality of loudspeaker means mounted on said casing and oriented to face in widely diverging directions, said plurality of loudspeaker means including at least one loudspeaker means which provides direct sound in the room and faces in a forwardly and sidewardly direction pointing slantwise towards said centered vertical plane, said plurality of loudspeaker means including at least another loudspeaker means which provides reflected sound in the room and faces in at least a rearwardly direction to cooperate with said sound reflecting wall, said at least one loudspeaker means which provides direct sound in the room radiating at least substantially one-half of the total sound-energy flux of said high frequency radiating means, and mid and low frequency radiating means comprising at least one loudspeaker means mounted to said casing, near said rear end of the casing, said at least one loudspeaker means for the midfrequency range being oriented to face in an upwardly and forwardly and sidewardly direction pointing slantwise towards said centered vertical plane.

* * * * *